US006681085B1

(12) United States Patent
Collard et al.

(10) Patent No.: US 6,681,085 B1
(45) Date of Patent: Jan. 20, 2004

(54) METHOD AND APPARATUS FOR PRINTING A SET OF CONSECUTIVE ORIGINAL PAGES ON A NUMBER OF RECEIVING SHEETS TO FORM A BOOKLET

(75) Inventors: René François Albert Collard, Gennep (NL); Eduardus J. W. Van Vliembergen, Venlo (NL)

(73) Assignee: Oce-Technologies B.V., Venlo (NL)

( * ) Notice: Subject to any disclaimer, the term of this patent is extended or adjusted under 35 U.S.C. 154(b) by 0 days.

(21) Appl. No.: 09/669,875

(22) Filed: Sep. 27, 2000

(30) Foreign Application Priority Data

Sep. 27, 1999 (NL) ..... 1013142

(51) Int. Cl.[7] ..... G03G 15/00
(52) U.S. Cl. ..... 399/82
(58) Field of Search ..... 399/82; 358/474

(56) References Cited

U.S. PATENT DOCUMENTS 4,592,651 A * 6/1986 Oikawa et al. ..... 355/72
5,057,869 A * 10/1991 Graves et al. ..... 399/204
5,212,568 A * 5/1993 Graves et al. ..... 358/474
5,808,747 A * 9/1998 Telle ..... 358/296
6,099,225 A * 8/2000 Allen et al. ..... 412/32
6,251,054 B1 * 6/2001 Cruz et al. ..... 493/383

FOREIGN PATENT DOCUMENTS

EP A1-0992365 4/2000

OTHER PUBLICATIONS

Xerox Disclosure Journal. vol. 12 No. 4 Jul./Aug. 1987.

* cited by examiner

*Primary Examiner*—Quana M. Grainger

(57) ABSTRACT

A method and apparatus for the printing of a set of consecutive original pages on a number of receiving sheets, wherein in a first printing mode in each case one page is printed on each side of a receiving sheet, and in a second printing mode two pages are printed next to one another on each side of a receiving sheet, and the receiving sheets are then double-folded. In the first printing mode, the first receiving sheet to be printed is the sheet that forms the front of the set of prints. For the printing of a set of original sheets formed as a booklet, the first sheet to be printed is the receiving sheet which forms the center of the booklet and the last sheet to be printed is the receiving sheet which forms the outside of the booklet. In the case of printing receiving sheets on both sides, in the first printing mode in each case, first a predetermined side of a receiving sheet is printed and in the second printing mode in each case, first a receiving sheet is printed on the side corresponding to the predetermined side in the first printing mode. Control means set the printing apparatus automatically to the second printing mode when the printing apparatus for making a booklet is set solely to double-folding and possibly stapling of the double-folded printed set of receiving sheets.

3 Claims, 3 Drawing Sheets

METHOD AND APPARATUS FOR PRINTING A SET OF CONSECUTIVE ORIGINAL PAGES ON A NUMBER OF RECEIVING SHEETS TO FORM A BOOKLET

BACKGROUND OF THE INVENTION

The present invention relates to a method of printing a set of consecutive original pages on a number of receiving sheets, either in a first printing mode in which in each case one page is printed on each side of a receiving sheet, or in a second printing mode in which two pages can be printed next to one another on each side of a receiving sheet and the receiving sheets are then double-folded to form a booklet.

A method of this kind is known from *Xerox Disclosure Journal*, July/August 1987, No. 4, pp. 179–180.

According to this known method, in the second printing mode for forming a booklet the first receiving sheet printed is the one which carries the first page of the required booklet. For a 12-page booklet the twelfth original page together with the first original page is printed first on a receiving sheet. In the case of automatic feed of original sheets from the bottom of a stack of original sheets, the originals are situated with pages numbers 1 and 12 at the bottom.

As a result of the increasing availability of printing apparatus with which folded booklets can be made, there will also be an increasing demand for making a copy of such a booklet. In order to use the above-mentioned known apparatus for this purpose, the folded booklet must be unfolded so that it can be put in in the form of a stack of original sheets. One disadvantage in this connection is that it is difficult to press the unfolded booklet flat, so that the sides of the booklet with the first page at the bottom project up and render separation of the original sheets difficult.

The object of the present invention is to provide a method without this disadvantage.

To this end, and for the purpose of printing a set of consecutive original sheets in the first printing mode, the first receiving sheet to be printed is a sheet that will form the front of the set, and therefore contains the first page, and for the purpose of printing a set of original sheets formed as a booklet, the first receiving sheet to be printed is the sheet that forms the center of the booklet and the last sheet to be printed is the receiving sheet which forms the outside of the booklet, and therefore contains the first page.

As a result, for the method of copying a booklet to form a booklet, use can be made of a printing apparatus in which original sheets of an unfolded booklet can be reliably separated from the bottom of a stack, i.e., when the originals are situated with their fold line disposed transversely of the feed direction of the originals.

Preferably, in the case of the printing of receiving sheets on both sides, in the first printing mode, in each case, first a predetermined side of a receiving sheet is printed and only then is the other side of said receiving sheet printed and in the second printing mode, in each case, a receiving sheet is first printed on the side which corresponds to the predetermined side in the first printing mode and only then the other side.

The effect of this is that when oriented receiving material is used, e.g. receiving material where at the side forming the front of a set of prints has a different surface color and/or texture from the other side, both printing modes have the result that the first page of the set comes on the same side of the receiving material without the receiving material having to be fed differently according to the printing mode that has been set.

The present invention also relates to a printing apparatus for performing the above method. Preferably, the printing apparatus comprises control means which automatically set the printing apparatus to the second printing mode when the printing apparatus for making a booklet is only set to double-folding and possibly stapling of a printed set of receiving sheets.

Consequently, the printing apparatus can immediately start printing the required booklet when the bottom original sheet forming the center of the unfolded booklet is separated from the rest of the stacked original sheets of the booklet for copying and has been scanned for printing.

In the case of introduction of a set of original sheets, each carrying one page, the printing apparatus must, in fact, be set to printing in a different page order from the page order in which the original sheets were scanned. For this purpose it is necessary that all the original sheets of a set should first be scanned before printing can start.

According to another aspect of the present invention, the control means also set the printing apparatus to the second printing mode when the printing apparatus for making a booklet of a set of original sheets each containing one page on a side has been set to a printing order adapted thereto.

BRIEF DESCRIPTION OF THE DRAWINGS

Other features and advantages of the invention will be explained hereinafter with reference to the accompanying drawings, wherein.

DETAILED DESCRIPTION OF THE INENTION

Figure 1:
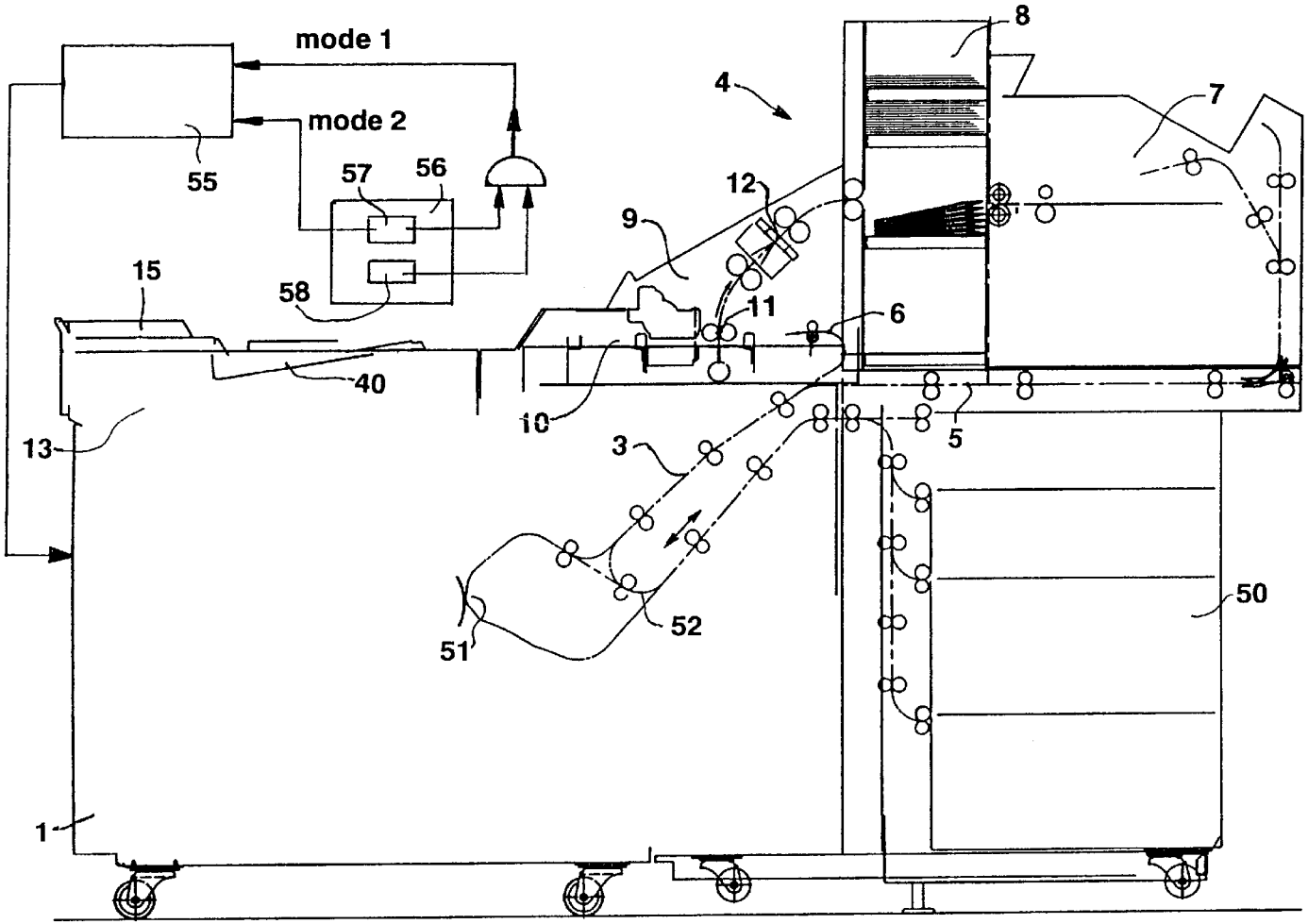
FIG. 1 shows a printing apparatus for printing and folding booklets and for printing unfolded stapled sets.

The printing apparatus 1 shown in FIG. 1 comprises a printing section, in which sheets of receiving material can be printed on both sides with two adjacent images. The printing apparatus 1 is provided with a sheet transport path 3 for transporting sheets, which have been printed with four images, from the printing section to a sheet finishing station 4 disposed at the top of the printing section. The sheet transport path 3 divides into a path 5 and a path 6. Path 5 serves for transporting sheets printed with one image on each side and which do not have to be folded together, but which are simply bundled together by a staple introduced in stapling station 7, the sheets then being deposited in delivery station 8. Path 6 serves for the transport of sheets printed with two images on each side to a folding and flattening device 9. A number of sheets can be collected in device 9 on a collecting station 10, in order then to be folded double together in a folding nip 11 and finally pressed flat in a flattening station 12. Folded booklets pressed flat in this way can be readily stacked in delivery trays of delivery station 8 without the stack height becoming extremely tall.

Figure 2:
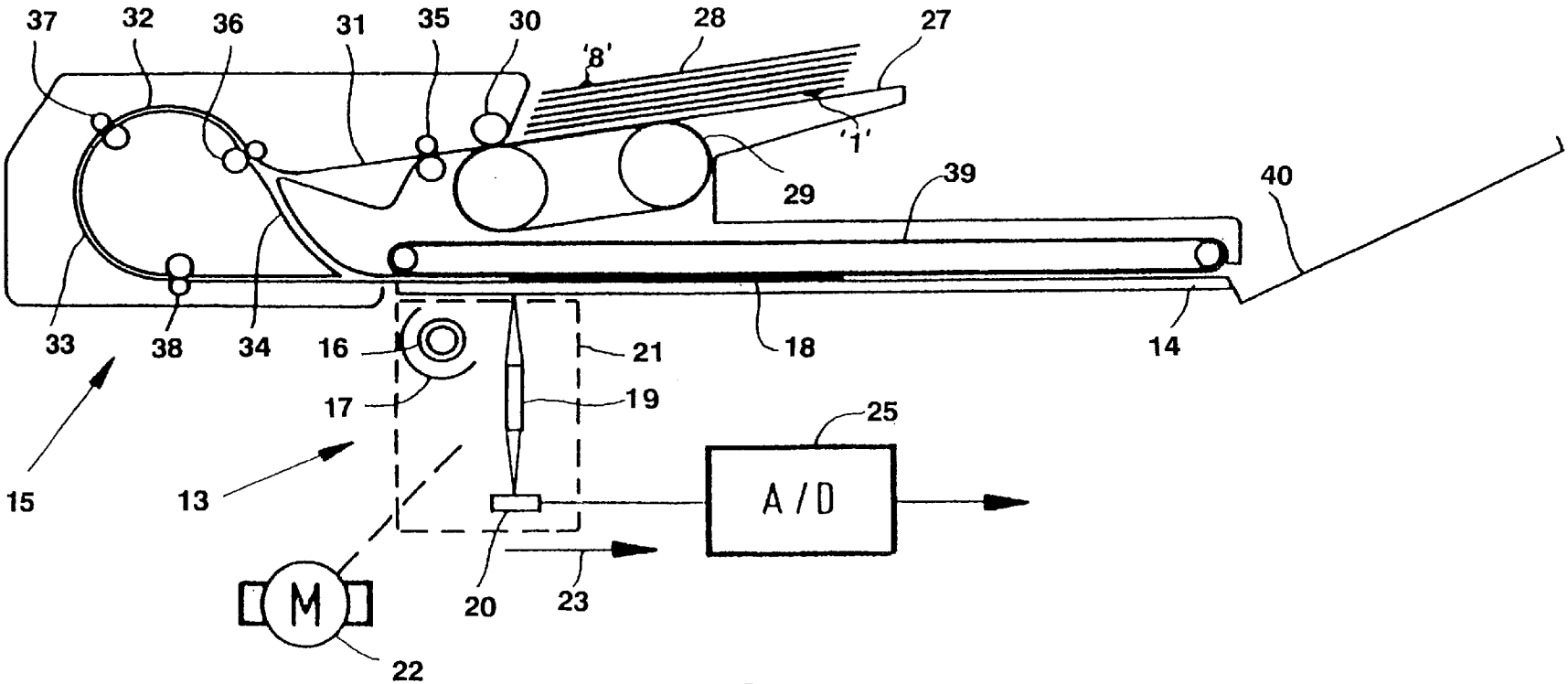
FIG. 2 shows a feed station for a set of original sheets in the printing apparatus shown in FIG. 1, each original sheet containing one page on a side.

The printing apparatus 1 is provided with a scanning station 13, shown in FIG. 2, for the opto-electric scanning of an original sheet disposed on a platen 14 and the delivery of digital image information corresponding thereto, which is printed in the printing section on receiving sheets fed through the sheet transport path 3. The scanning station 13 equipped with a feed station 15 for automatically feeding original sheets one by one to the platen, is shown in greater detail in FIGS. 2 and 3.

The scanning station 13 is provided with a tubular lamp 16 and a reflector 17 co-operating therewith, with which a narrow strip of an original sheet 18 placed on the platen 14 is exposed. The scanning station 13 also comprises an array 19 of imaging glass fibers (a "selfoc lens array"), by means of which the light reflected by the original sheet is projected on a sensor array, e.g. a CCD array 20. The lamp 16, reflector 17, selfoc lens array 19 and the CCD array 20 are combined on a carriage 21 which, during scanning, is advanced by a servomotor 22 at uniform speed in the direction of arrow 23, so that the original sheet 18 is scanned line-wise by the CCD array 20.

Thus each pixel of the document is converted into an analogue signal which corresponds to the grey value of that pixel. The analogue signal is then converted by an A/D converter 25 to a digital signal for each pixel.

The feed station 15 for original sheets comprises an entry tray 27 to receive a stack of original sheets 28 for copying, a separating mechanism 29, 30 for separating original sheets one by one from the bottom of the stack, and a transport system, consisting of the transport paths 31, 32, 33 and 34 and the transport roller pairs 35, 36, 37 and 38, for transporting an original sheet to the platen after it has been separated. This original sheet 18 is transported over the platen 14 by a conveyor belt 39 which, after the scanning by the scanning carriage 21, conveys it to the delivery tray 40.

For the scanning of original sheets printed on one side only, the bottom original sheet is fed from a stack of original sheets 28 which have been placed in the entry tray 27 with the image sides facing downwards. Transport roller pairs 35 convey the sheet in transport path 31 and then further feed the sheet by transport roller pairs 36 and 37 in transport paths 32 until the trailing edge of the original sheet supplied has been completely fed out of the transport path 31. After reversal of the direction of rotation of the transport rollers 36 and 37, the latter feed the original sheet via transport path 34 to the platen 14 for the scanning of the printed side.

For the scanning of original sheets printed on two sides, the bottom original sheet of a stack of original sheets 28 which have been placed in the entry tray 27 with the odd numbered image sides facing downwards, is fed by transport roller pair 35 in transport path 31 and then fed by transport roller pairs 36, 37 and 38 via transport paths 32 and 33 to the platen 14. After the scanning of the downwardly facing side, the original sheet is fed from the platen, by reversal of the direction of transport of the conveyor belt 39 situated on the platen 14, and returned, via the return loop formed by transport paths 33, 32 and 34, in the inverted position to the platen 14 for the scanning of the other side of the duplex printed original sheet. When a set of original sheets 28 printed on both sides is placed in the entry tray 27 with the first page of the set facing downwards (face-down entry, comparable to the entry of a set of original sheets printed on one side only), the pages are scanned in the page order 2-1-4-3, 6-5, and so on, and after scanning the original sheets 28 are delivered to the delivery tray 40 with their original orientation.

A set of original sheets, of which a copy is to be made in the form of a folded booklet, can be present in one of three basic forms:

a) A set of original sheets printed on one side only with one page on each original sheet of the set, b) A set of original sheets printed on both sides with one page on each side of each original sheet of the set, or c) A set of original sheets printed on both sides with two pages on each side of each original sheet of the set, the page order corresponding to the required page order of the copy to be made of the original booklet.

Since, in the printing of receiving sheets which are to form a booklet with a number of pages divisible by 4, the first page (1) and the last page (n) must be printed on one side and the second page (2) and the second last page (n-1) must be printed on the other side of the said receiving sheet, and pages 3 and n-2 on one side of the next receiving sheet and pages 4 and n-4 on the other side, and so on. The page order for printing the original sheets scanned in accordance with a) and b) differs from the order in which the pages are to be scanned. For the basic forms a) and b) referred to above, the page order to be programmed for the printing of a booklet is one which is dependent on the number of pages of the set of original sheets for copying. The printing of a set of original sheets cannot therefore start until the entire set of original sheets has been scanned.

For the basic form c) in which the pages of the set of original sheets are in fact scanned in the required printing order, a page programming of this kind is unnecessary and does not therefore have to be set. Another advantage is that for printing a set of copies of this kind to form a booklet, printing can start directly after the first original of the set of original sheets in book form has been scanned. Particularly in the case of a thick booklet, a considerable saving in time is achieved.

Before discussing in detail the control system for making prints in dependence on the form in which the original sheets are supplied and the mode to which the printing apparatus has been set, the route taken by receiving sheets from the supply station 50 via the image transfer station 51 to the delivery station 8 will be explained.

Receiving sheets which are to be printed on only one side and which are fed from the supply station 50 via the stapling station 7 to the delivery station 8 are normally printed on that side which faces down in the supply station 50 and are deposited in the delivery station 8 with the printed side facing down.

Receiving sheets which are to be printed on both sides and which must also be stapled in stapling station 7, are returned, in an inverted position, after the printing of the side which faced down in the supply station, to the image transfer station where the receiving sheet printed on both sides is turned over, before reaching the stapling station 7, in the transport path 5 which is situated between the image transfer station 51 and the stapling station 7, so that the receiving sheet printed on both sides is deposited in delivery station 8 with the side that was printed first facing down.

The effect achieved as a result is that in the case of printing on oriented receiving material having a front page formed in a different manner, e.g. a front page with a different texture or color intended particularly to form the front page (cover) of a copy set, the said oriented receiving material can always be placed in the supply station in the same orientation (in this case: with said special page facing down, a receiving sheet also being deposited with all its special pages facing down in the delivery station 8, i.e. irrespective of whether the receiving sheet is printed on one or both sides.

In the case of printing on non-oriented receiving material, the printing sequence for each sheet can also be the back first and then the front, as explained at the start of the description of the drawings, the advantage being that in this case there is no need to invert a receiving sheet after the duplex printing for it to be deposited in the delivery station 8 with its front side facing down.

Receiving sheets which are to be printed on both sides and which will form part of a booklet are fed via transport path 6 to the collecting station 10. The top side of the receiving sheets supplied as the last of a set carries the first and last page of the required booklet. If this receiving sheet which is the last to be fed is oriented receiving material, which as described hereinbefore lies with its special side facing down in the supply station 50, then this special side, which is to form the outside of the booklet, is the first to be printed and then the other side thereafter.

When a receiving sheet printed in this way is deposited in the collecting station 10 as the last of the set, the special outside of the booklet faces upwards in the collecting station 10, since path 6 has no extra sheet inversion, as was the case in path 5 for receiving sheets printed on both sides and requiring stapling in stapling station 7. The control system 55 diagrammatically illustrated in FIG. 1 for the printing apparatus 1 is adapted, to make a booklet of, for example, 16 pages on four receiving sheets, to carry out the following printing sequence: 7/10, 8/9, 5/12, 3/14, 4/13, 1/16 and 2/15 to:

$$\begin{array}{c|c} 16 & 1 \\ \hline 15 & 2 \\ \\ 14 & 3 \\ \hline 13 & 4 \\ \\ 12 & 5 \\ \hline 11 & 6 \\ \\ 10 & 7 \\ \hline 9 & 8 \end{array} \qquad (1)$$

$$\uparrow$$

This corresponds to the printing order when printing a copy set of 4 sheets and 8 pages in the order 2, 1, 4, 3, 6, 5, 8 and 7 to:

$$\begin{array}{c} 8 \\ \hline 7 \\ \\ 6 \\ \hline 5 \\ \\ 4 \\ \hline 3 \\ \\ 2 \\ \hline 1 \end{array} \qquad (2)$$

As shown in FIG. 2, a set of original sheets printed as (2), of which it may or may not be required to form a folded copy set, is placed in the entry tray 27 with page 1 in a face-down position.

If a folded booklet is to be made from this introduced set of original sheets, then first of all the original pages must be scanned and stored in a memory to enable the control device 55 to be able to print the pages in suitable sequence to form a booklet printed as (1). The control device 55 performs this page programming automatically when the printing apparatus operator uses button 58 on operator control panel 56 to set this required page programming in addition to using button 57 to indicate that a copy is required in the form of a folded booklet.

Figure 3:
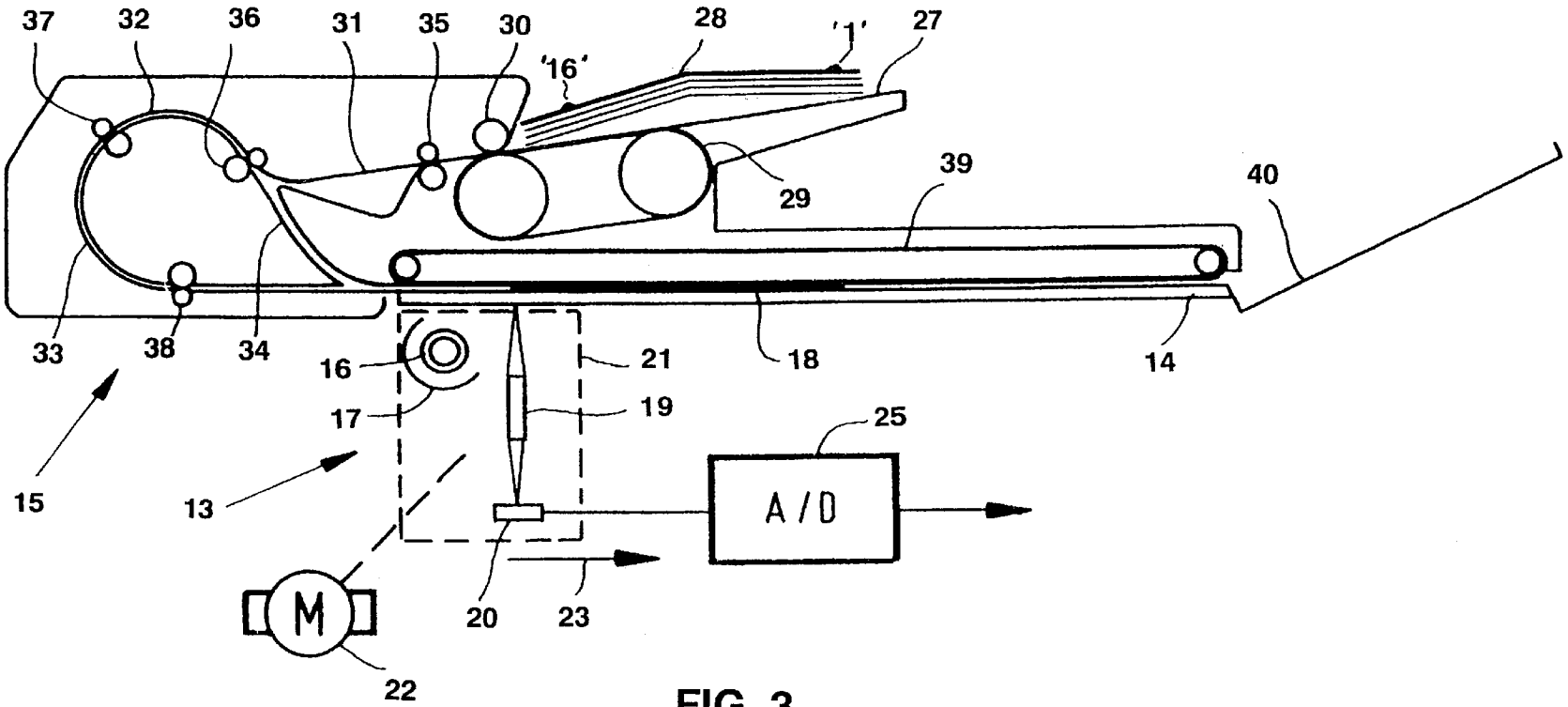
FIG. 3 shows the feed station of FIG. 2 for a set of original sheets which form an unfolded booklet, each original sheet containing two pages on one side.

If this setting by means of button 58 is omitted on the operator control panel 56, while the operator uses button 57 to indicate that he wants a copy in the form of a folded booklet, then, after actuation of a start button, the control device 55 automatically sets the printing apparatus 2 to making a copy booklet of an original booklet which, after unfolding and unstapling, is placed as a stack of original sheets 1 in the entry tray 27 in the manner shown in FIG. 3, i.e. in the orientation according to (1) with page 1 facing upwards.

Since the booklet for copying has been unfolded as shown in FIG. 3, the edge of the booklet near the separating nip formed by belt 29 and roller 30 will be in contact with the belt 29, and this guarantees good separation of the original sheets from stack 28'.

As shown in FIG. 1, both unfolded copy sets stapled in station 7 and folded copy sets formed into a booklet in station 9 are deposited in a common delivery station 8. To this end, the finishing stations 7 and 9 are situated on either side of the delivery station 8 as shown in FIG. 1. This results in a versatile but very compact finishing system for copy sets.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of printing a set of consecutive original pages on a number of receiving sheets, either in a first printing mode in which in each case one page is printed on each side of a receiving sheet, or in a second printing mode in which two pages can be printed next to one another on each side of the receiving sheet and the receiving sheets are then double-folded to form a booklet, wherein for the purpose of printing a set of consecutive original sheets in the first printing mode, the first receiving sheet to be printed is the sheet that will form the front of the set of prints, and therefore contains the first page, and that for the purpose of printing a set of original sheets formed as a booklet the first receiving sheet to be printed is the sheet that forms the center of the booklet and the last sheet to be printed is the receiving sheet which forms the outside of the booklet, and therefore contains the first page.

2. A method according to claim 1, wherein in the case of the printing of receiving sheets on both sides in the first printing mode in each case, first a predetermined side of a receiving sheet is printed and only then is the other side of said receiving sheet printed and wherein, in the second printing mode, in each case a receiving sheet is first printed on the side which corresponds to the predetermined side in the first printing mode and only then the other side is printed.

3. A method of presenting originals to be reproduced to a reproduction location of a copying system, which includes a document feeder having a tray for receiving a stack of original sheets to be copied and a control means for controlling the copying system to produce copy sets in correct page sequential order, said method comprising:

stacking original sheets carrying only one image page on an imaged side in the tray of the document feeder in their logical, page sequential order with the first page facing to the bottom of the tray; and stacking original sheets consisting of an unfolded booklet carrying two image pages on each side of the sheets in the tray, of the feeder in the sheet sequential order with the first page of the unfolded booklet facing upward, wherein the control means includes input means for indicating an unfolded booklet being placed in the document feeder tray.

* * * * *